US011051375B2

(12) United States Patent
Pan et al.

(10) Patent No.: US 11,051,375 B2
(45) Date of Patent: Jun. 29, 2021

(54) COLOR ADJUSTING METHOD FOR COLOR LIGHT-EMITTING ELEMENT AND INPUT DEVICE WITH COLOR ADJUSTING FUNCTION

(71) Applicant: Primax Electronics Ltd., Taipei (TW)

(72) Inventors: Ding-Hsiang Pan, Taipei (TW); Hui-Ling Lin, Taipei (TW); Chuan-Tai Hsiao, Taipei (TW); Chun-Han Huang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 71 days.

(21) Appl. No.: 16/581,053

(22) Filed: Sep. 24, 2019

(65) Prior Publication Data

US 2021/0022217 A1 Jan. 21, 2021

(30) Foreign Application Priority Data

Jul. 19, 2019 (TW) ..... 108125701

(51) Int. Cl.
*H05B 45/20* (2020.01)
*G09G 5/02* (2006.01)

(52) U.S. Cl.
CPC ..... *H05B 45/20* (2020.01); *G09G 5/026* (2013.01); *G09G 2320/0666* (2013.01)

(58) Field of Classification Search
None
See application file for complete search history.

(56) References Cited

U.S. PATENT DOCUMENTS

| | | | | |
|---|---|---|---|---|
| 9,501,962 | B2 * | 11/2016 | Ando | G09G 3/2022 |
| 2010/0072900 | A1 * | 3/2010 | Deppe | G03B 21/2053 315/151 |
| 2020/0253009 | A1 * | 8/2020 | Hsu | H05B 45/20 |
| 2020/0273913 | A1 * | 8/2020 | Song | G09G 3/2003 |

* cited by examiner

*Primary Examiner* — Nicholas J Lee
(74) *Attorney, Agent, or Firm* — Kirton McConkie; Evan R. Witt

(57) ABSTRACT

A color adjusting method for a color light-emitting element is provided. Firstly, a first white light beam is produced by red, green and blue light-emitting units collaboratively, and a second white light beam is produced by a white light-emitting unit. Then, a second chromaticity value corresponding to the second white light beam is acquired. Then, the red, green and blue light-emitting units are controlled to produce a third white light beam according to the second chromaticity value, and a first adjusting parameter is acquired. Then, the white light-emitting unit is controlled to produce a fourth white light beam according to a third luminance value corresponding to the third white light beam, and a second adjusting parameter is acquired. Then, a gray level adjustment process is performed according to the first and second adjusting parameters.

12 Claims, 3 Drawing Sheets

COLOR ADJUSTING METHOD FOR COLOR LIGHT-EMITTING ELEMENT AND INPUT DEVICE WITH COLOR ADJUSTING FUNCTION

FIELD OF THE INVENTION

The present invention relates to an input device, and more particularly to an input device with a luminous function.

BACKGROUND OF THE INVENTION

With increasing development of science and technology, computer hosts are popular to the general users. In some situations, the user has plural computer hosts. Generally, the computer host and an input device are collaboratively formed as a computer system. The input device is used as a communication bridge between the computer host and the user. The computer system can be operated by the user through the input device. The input device includes a display screen, a keyboard, a mouse, or the like.

For increasing the functions and applications of the input device, an input device with a luminous function has been introduced into the market. For example, the input device with the luminous function includes a luminous keyboard or a luminous mouse. According to various settings, the input device with the luminous function can produce different luminous effects to provide the desired visual effect. Especially, the input device further comprises a color light-emitting element to provide abundant colorful luminous effect.

FIG. 1 is a schematic functional block diagram illustrating a portion of a conventional input device with a luminous function. The input device 1 comprises a universal serial bus (USB) interface 11, a red light-emitting unit 12, a green light-emitting unit 13, a blue light-emitting unit 14, a microprocessor 15 and a driving circuit 16. The red light-emitting unit 12, the green light-emitting unit 13 and the blue light-emitting unit 14 are collaboratively constituted as a color light-emitting element. The USB interface 11 is electrically connected between a computer host 10 and the microprocessor 15. The driving circuit 16 is connected with the microprocessor 15, the red light-emitting unit 12, the green light-emitting unit 13 and the blue light-emitting unit 14. The microprocessor 15 acquires electricity from the computer host 10 through the USB interface 11. Consequently, the microprocessor 15 provides a first driving current I11, a second driving current I12 and a third driving current I13 to the red light-emitting unit 12, the green light-emitting unit 13 and the blue light-emitting unit 14, respectively.

When the first driving current I11 is transmitted to the red light-emitting unit 12 through the driving circuit 16, the red light-emitting unit 12 emits a red light beam. When the second driving current I12 is transmitted to the green light-emitting unit 13 through the driving circuit 16, the green light-emitting unit 13 emits a green light beam. When the third driving current I13 is transmitted to the blue light-emitting unit 14 through the driving circuit 16, the blue light-emitting unit 14 emits a blue light beam. According to the practical requirements, the red light beam, the green light beam and the blue light beam may be mixed together. Consequently, the mixed light beam with a specified color can be outputted from the conventional input device 1.

With the development of the input device, the demands of the user on the visual effect and the power-saving efficacy of the input device are gradually increased. Consequently, an input device with a new color light-emitting element has been introduced to the market. The new color light-emitting element is a combination of a red light-emitting unit, a green light-emitting unit, a blue light-emitting unit and a white light-emitting unit. When compared with the color light-emitting element including the red light-emitting unit, the green light-emitting unit and the blue light-emitting unit, the new color light-emitting element including the red light-emitting unit, the green light-emitting unit, the blue light-emitting unit and the white light-emitting unit consumes less amount of electric power. Consequently, the new color light-emitting element has the power-saving efficacy.

However, the new color light-emitting element still has some drawbacks. After the light beams from the red light-emitting unit, the green light-emitting unit, the blue light-emitting unit and the white light-emitting unit are mixed, a mixed light beam is produced. After the mixed light beam is subjected to a gray level adjustment process, the color of the adjusted light beam is somewhat different from the color of the mixed light beam of the new color light-emitting element. That is, the luminance and the chromaticity of the mixed light beam from the new color light-emitting element may have errors.

Therefore, there is a need of providing an improved input device to reduce the errors of the luminance and the chromaticity of the mixed light beam.

SUMMARY OF THE INVENTION

An object of the present invention provides an input device to reduce the errors of the luminance and the chromaticity of the mixed light beam.

An object of the present invention provides a color adjusting method for a color light-emitting element to reduce the errors of the luminance and the chromaticity of the mixed light beam.

In accordance with an aspect of the present invention, a color adjusting method for a color light-emitting element of an input device is provided. The color light-emitting element includes a red light-emitting unit, a green light-emitting unit, a blue light-emitting unit and a white light-emitting unit. The color adjusting method included the following steps. In a step (A), the color light-emitting element is enabled. After the color light-emitting element is enabled, a first white light beam is produced by the red light-emitting unit, the green light-emitting unit and the blue light-emitting unit collaboratively, and a second white light beam is produced by the white light-emitting unit. In a step (B), the second white light beam is measured to acquire a second chromaticity value corresponding to the second white light beam. In a step (C), the red light-emitting unit, the green light-emitting unit and the blue light-emitting unit are controlled to produce a third white light beam according to the second chromaticity value, and a first adjusting parameter corresponding to the red light-emitting unit, the green light-emitting unit and the blue light-emitting unit is acquired. A third chromaticity value corresponding to the third white light beam matches the second chromaticity. In a step (D), the white light-emitting unit is controlled to produce a fourth white light beam according to a third luminance value corresponding to the third white light beam, and a second adjusting parameter corresponding to the white light-emitting unit is acquired. A fourth luminance value corresponding to the fourth white light beam matches the third luminance value. In a step (E), a gray level adjustment process is performed according to the first adjusting parameter and the second adjusting parameter.

In an embodiment, the step (C) includes sub-steps (C1), (C2), (C3), (C4) and (C5). In the sub-step (C1), a current value corresponding to the red light-emitting unit is adjusted according to the second chromaticity value, so that the red light-emitting unit emits a second red light beam. In the sub-step (C2), a current value corresponding to the green light-emitting unit is adjusted according to the second chromaticity value, so that the green light-emitting unit emits a second green light beam. In the sub-step (C3), a current value corresponding to the blue light-emitting unit is adjusted according to the second chromaticity value, so that the blue light-emitting unit emits a second blue light beam. The second red light beam, the second green light beam and the second blue light beam are mixed as the third white light beam. The sub-step (C4) is performed to judge whether the third chromaticity value corresponding to the third white light beam matches the second chromaticity value. In the sub-step (C5), the current value corresponding to the red light-emitting unit, the current value corresponding to the green light-emitting unit and the current value corresponding to the blue light-emitting unit are retrieved as the first adjusting parameter.

In an embodiment, the step (D) includes sub-steps (D1), (D2) and (D3). In the sub-step (D1), a current value corresponding to the white light-emitting unit is adjusted according to the third luminance value, so that the fourth white light beam is produced by the white light-emitting unit. The sub-step (D2) is performed to judge whether the fourth luminance value corresponding to the fourth white light beam matches the third luminance value. In the sub-step (D3), the current value corresponding to the white light-emitting unit is retrieved as the second adjusting parameter.

In accordance with another aspect of the present invention, an input device with a color adjusting function is provided. The input device includes a casing, a color light-emitting element and a control module. The color light-emitting element is disposed within the casing, and includes a red light-emitting unit, a green light-emitting unit, a blue light-emitting unit and a white light-emitting unit. The red light-emitting unit is disposed within the casing and emits a red light beam to the casing. The green light-emitting unit is disposed within the casing and emits a green light beam to the casing. The blue light-emitting unit is disposed within the casing and emits a blue light beam to the casing. The white light-emitting unit is disposed within the casing and emits a white light beam to the casing. The control module is disposed within the casing, and connected with the red light-emitting unit, the green light-emitting unit, the blue light-emitting unit and the white light-emitting unit. The control module adjusts an adjusting parameter corresponding to the red light-emitting unit, the green light-emitting unit, the blue light-emitting unit and the white light-emitting unit. According to the adjusting parameter, a chromaticity value of a mixed light beam of the red light beam, the green light beam and the blue light beam is adjusted to match a chromaticity value of the white light beam from the white light-emitting unit, and a luminance value of an additional white light beam from the white light-emitting unit is adjusted to match a luminance value of the mixed light beam.

If the chromaticity value of the mixed light beam is adjusted to match the chromaticity value of the white light beam, the control module retrieves a current value corresponding to the red light-emitting unit, a current value corresponding to the green light-emitting unit and a current value corresponding to the blue light-emitting unit. Whereas, if the chromaticity value of the mixed light beam does not match the chromaticity value of the mixed light beam, the control module adjusts the chromaticity value of the white light beam again.

If the luminance value of the additional white light beam is adjusted to match the luminance value of the mixed light beam, the control module retrieves the current value corresponding to the white light-emitting unit. Whereas, if the luminance value of the additional white light beam does not match the luminance value of the mixed light beam, the control module adjusts the luminance value of the additional white light beam again.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
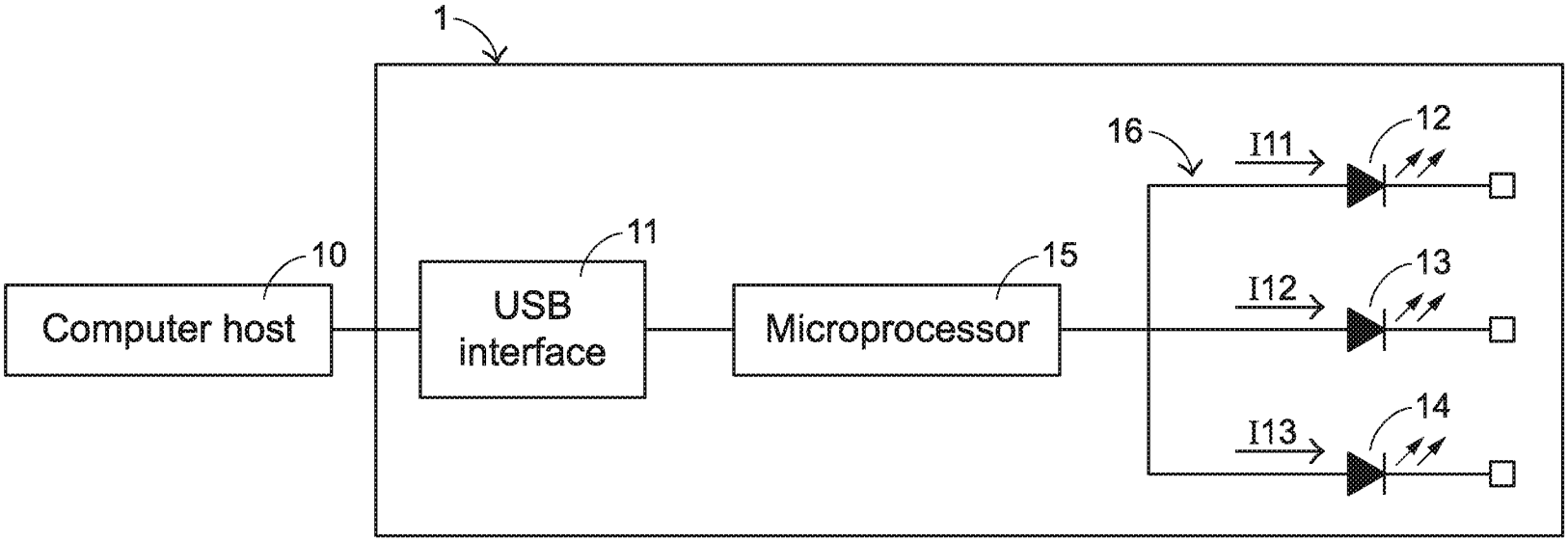
FIG.1 PRIOR ART
FIG. 1 is a schematic functional block diagram illustrating a portion of a conventional input device with a luminous function.

The present invention provides an input device with a color adjusting function and a color adjusting method for a color light-emitting element in order to overcome the drawbacks of the conventional technologies. The embodiments of present invention will be described more specifically with reference to the following drawings. For well understanding the present invention, the elements shown in the drawings are not in scale with the elements of the practical product. In the following embodiments and drawings, the elements irrelevant to the concepts of the present invention or the elements well known to those skilled in the art are omitted. It is noted that numerous modifications and alterations may be made while retaining the teachings of the invention.

Figure 2:
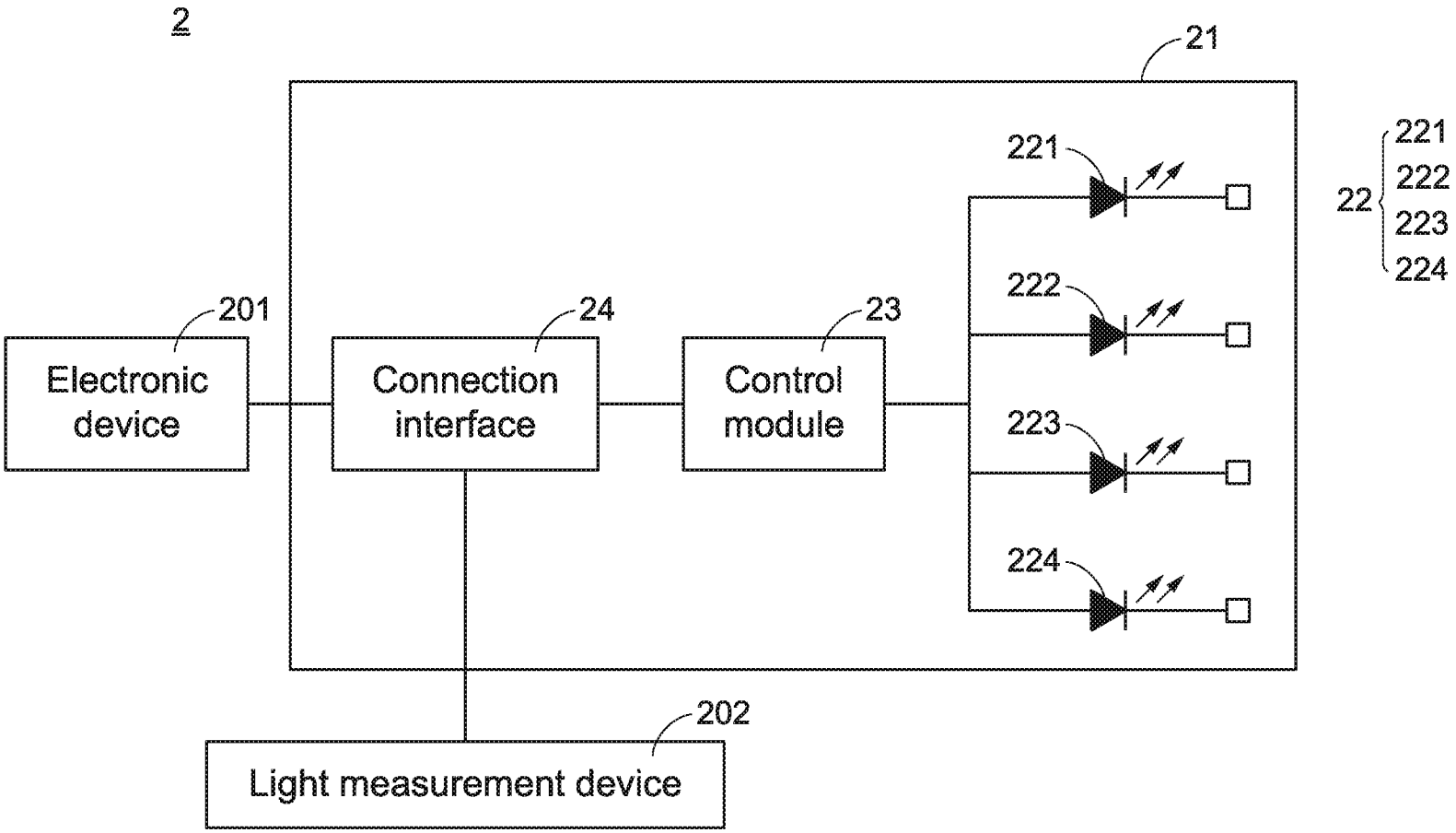
FIG. 2 is a schematic functional block diagram illustrating a portion of an input device with a color adjusting function according to an embodiment of the present invention.

FIG. 2 is a schematic functional block diagram illustrating a portion of an input device with a color adjusting function according to an embodiment of the present invention. The input device 2 is connected with an electronic device 201 and a light measurement device 202. The input device 2 comprises a casing 21, a color light-emitting element 22, a control module 23 and a connection interface 24. The color light-emitting element 22 is disposed within the casing 21. The color light-emitting element 22 comprises a red light-emitting unit 221, a green light-emitting unit 222, a blue light-emitting unit 223 and a white light-emitting unit 224. The red light-emitting unit 221 is disposed within the casing 21. When the red light-emitting unit 221 is driven by the control module 23, the red light-emitting unit 221 emits a red light beam to casing 21. The green light-emitting unit 222 is disposed within the casing 21. When the green light-emitting unit 222 is driven by the control module 23, the green light-emitting unit 222 emits a green light beam to casing 21. The blue light-emitting unit 223 is disposed within the casing 21. When the blue light-emitting unit 223 is driven by the control module 23, the blue light-emitting unit 223 emits a blue light beam to casing 21. The white light-emitting unit 224 is disposed within the casing 21.

When the white light-emitting unit 224 is driven by the control module 23, the white light-emitting unit 224 emits a white light beam to casing 21. In this embodiment, the color light-emitting element 22 is a RGBW light emitting diode module, and the input device 2 is a luminous mouse. It is noted that the example of the input device is not restricted. For example, in another embodiment, the input device is a luminous keyboard.

The connection interface 24 is disposed within the casing 21. The connection interface 24 is connected with the control module 23, the electronic device 201 and the light measurement device 202. The electronic device 201 and the light measurement device 202 are located outside the input device. The connection interface 24 receives the electric power from the electronic device 201 and transmits the electric power to the control module 23. In an embodiment, the light measurement device 202 includes a luminance meter for measuring the luminance of the light beam and a chromatometer for measuring the chromaticity of the light beam. An example of the connection interface 24 includes but is not limited to a universal serial bus (USB) interface. In this embodiment, the electronic device 201 and the light measurement device 202 are connected with the input device 2 through the same connection interface 24. Alternatively, in another embodiment, the electronic device 201 and the light measurement device 202 are connected with the input device 2 through different connection interfaces. In other words, the connection interface 24 is not restricted to the single type connection interface.

The control module 23 is disposed within the casing 21, and connected with the red light-emitting unit 221, the green light-emitting unit 222, the blue light-emitting unit 223, the white light-emitting unit 224 and the connection interface 24. The color adjusting method of the color light-emitting element 22 is executed by the control module 23. That is, according to the practical requirements, the adjusting parameters of the red light-emitting unit 221, the green light-emitting unit 222, the blue light-emitting unit 223 and the white light-emitting unit 224 are controlled. Consequently, the red light-emitting unit 221, the green light-emitting unit 222, the blue light-emitting unit 223 and the white light-emitting unit 224 are controlled to emit the red light beam, the green light beam, the blue light beam and the white light beam. In an embodiment, the control module 23 is a microprocessor or a firmware installed in the microprocessor.

Figure 3:
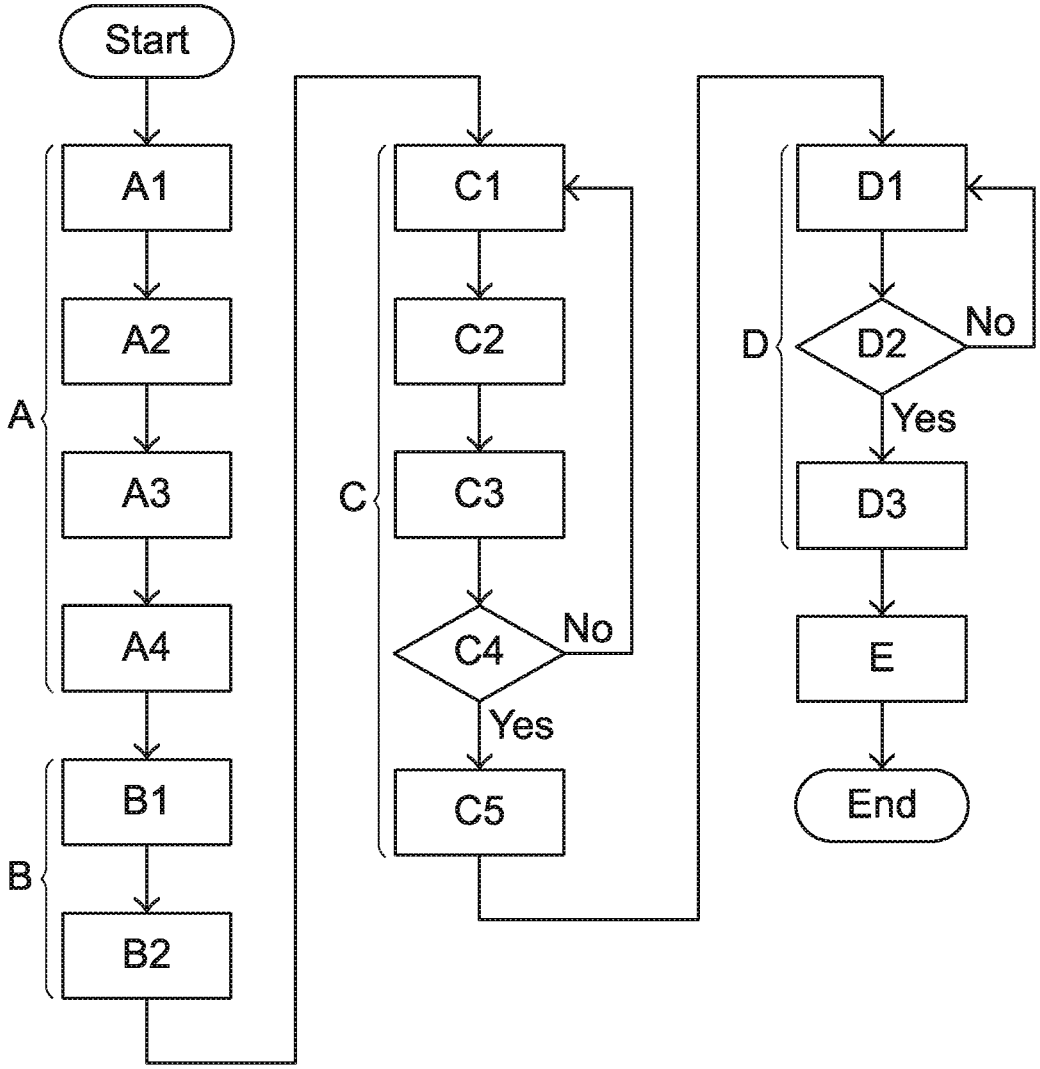
FIG. 3 is a flowchart illustrating a color adjusting method of the color light-emitting element according to an embodiment of the present invention.

A color adjusting method of the color light-emitting element 22 executed by the control module 23 will be described as follows. FIG. 3 is a flowchart illustrating a color adjusting method of the color light-emitting element according to an embodiment of the present invention.

In a step A, the color light-emitting element is enabled. Consequently, a first white light beam is produced by the red light-emitting unit, the green light-emitting unit and the blue light-emitting unit collaboratively, and a second white light beam is produced by the white light-emitting unit. In a step B, the light measurement device acquires a second chromaticity value corresponding to the second white light beam. In a step C, a third white light beam is produced by the red light-emitting unit, the green light-emitting unit and the blue light-emitting unit collaboratively according to the second chromaticity value, and a first adjusting parameter corresponding to the red light-emitting unit, the green light-emitting unit and the blue light-emitting unit is acquired. Moreover, a third chromaticity value corresponding to the third white light beam matches the second chromaticity. In a step D, a fourth white light beam is produced by the white light-emitting unit according to a third luminance value corresponding to the third white light beam, and a second adjusting parameter corresponding to the white light-emitting unit is acquired. Moreover, a fourth luminance value corresponding to the fourth white light beam matches the third luminance value. In a step E, a gray level adjustment process is performed according to the first adjusting parameter and the second adjusting parameter.

The step A comprises the sub-steps A1, A2, A3 and A4. In the sub-step A1, the red light-emitting unit is driven to emit a first red light beam. In a sub-step A2, the green light-emitting unit is driven to emit a first green light beam. In a sub-step A3, the blue light-emitting unit is driven to emit a first blue light beam. In a sub-step A4, the white light-emitting unit is driven to emit the second white light beam.

The step B comprises sub-steps B1 and B2. In the sub-step B1, the first white light beam is measured, and a first luminance value and a first chromaticity value corresponding to the first white light beam are acquired. In the sub-step B2, the second white light beam is measured, and a second luminance value and a second chromaticity value corresponding to the second white light beam are acquired.

The step C comprises the sub-steps C1, C2, C3, C4 and C5. In the sub-step C1, the current value corresponding to the red light-emitting unit is adjusted according to the second chromaticity value, and thus the red light-emitting unit is controlled to emit a second red light beam. In the sub-step C2, the current value corresponding to the green light-emitting unit is adjusted according to the second chromaticity value, and thus the green light-emitting unit is controlled to emit a second green light beam. In the sub-step C3, the current value corresponding to the blue light-emitting unit is adjusted according to the second chromaticity value, and thus the blue light-emitting unit is controlled to emit a second blue light beam. The sub-step C4 is performed to judge whether the third chromaticity value corresponding to the third white light beam matches the second chromaticity value. In the sub-step C5, the current value corresponding to the red light-emitting unit, the current value corresponding to the green light-emitting unit and the current value corresponding to the blue light-emitting unit are retrieved as the first adjusting parameter.

If the judging result of the sub-step C4 indicates that the third chromaticity value corresponding to the third white light beam matches the second chromaticity value, the sub-step C5 is performed. Whereas, if the judging result of the sub-step C4 indicates that the third chromaticity value corresponding to the third white light beam does not match the second chromaticity value, the step C1 is repeatedly done.

The step D comprises sub-steps D1, D2 and D3. In the sub-step D1, the current value corresponding to the white light-emitting unit is adjusted according to the third luminance value, and thus the fourth white light beam is produced by the white light-emitting unit. The sub-step D2 is performed to judge whether the fourth luminance value corresponding to the fourth white light beam matches the third luminance value. In the sub-step D3, the current value corresponding to the white light-emitting unit is retrieved as the second adjusting parameter.

If the judging result of the sub-step D2 indicates that the fourth luminance value corresponding to the fourth white light beam matches the third luminance value, the sub-step D3 is performed. Whereas, if the judging result of the sub-step D2 indicates that the fourth luminance value corresponding to the fourth white light beam does not match the third luminance value, the step D1 is repeatedly done.

The operations of the color adjusting method for the input device 2 will be described as follows.

Please refer to FIGS. 2 and 3. The color adjusting method of the present invention may be enabled according to two approaches. In accordance with a first approach, the color adjusting method is automatically enabled by the control module 23 when the input device 2 is turned on. In accordance with a second approach, the color adjusting method is manually enabled when the user operates a control interface (not shown) in the electronic device 201 (e.g., a computer host).

Firstly, the step A is performed. That is, the control module 23 performs the sub-steps A1, A2 and A3. The red light-emitting unit 221 is driven to emit a first red light beam. The green light-emitting unit 222 is driven to emit a first green light beam. The blue light-emitting unit 223 is driven to emit a first blue light beam. The first red light beam, the first green light beam and the first blue light beam are mixed as the first white light beam. Moreover, the control module 23 performs the sub-step A4. That is, the white light-emitting unit 224 is driven to emit the second white light beam.

After the step A is completed, the control module 23 performs the sub-step B1. The light measurement device 202 is enabled to measure the first white light beam, and thus a first luminance value L1 and a first chromaticity value (Xw1, Yw1) corresponding to the first white light beam are acquired. The control module 23 performs the sub-step B2. The light measurement device 202 is enabled to measure the second white light beam, and thus a second luminance value L2 and a second chromaticity value (Xw2, Yw2) corresponding to the second white light beam are acquired.

Then, the control module 23 performs the sub-steps C1, C2 and C3. In the sub-step C1, the current value corresponding to the red light-emitting unit 221 is adjusted according to the second chromaticity value (Xw2, Yw2), and thus the red light-emitting unit 221 is controlled to emit a second red light beam. In the sub-step C2, the current value corresponding to the green light-emitting unit 222 is adjusted according to the second chromaticity value (Xw2, Yw2), and thus the green light-emitting unit 222 is controlled to emit a second green light beam. In the sub-step C3, the current value corresponding to the blue light-emitting unit 223 is adjusted according to the second chromaticity value (Xw2, Yw2), and thus the blue light-emitting unit 223 is controlled to emit a second blue light beam. Meanwhile, the second red light beam, the second green light beam and the second blue light beam are mixed as the third white light beam. Moreover, the light measurement device 202 is enabled to measure the third white light beam, and thus a third luminance value L3 and a third chromaticity value (Xw3, Yw3) corresponding to the third white light beam are acquired.

Then, the control module 23 performs the sub-step C4. After the third chromaticity value (Xw3, Yw3) is acquired, the control module 23 judges whether the third chromaticity value (Xw3, Yw3) corresponding to the third white light beam matches the second chromaticity value (Xw2, Yw2) corresponding to the second white light beam. If the coordinates of the third chromaticity value (Xw3, Yw3) and the second chromaticity value (Xw2, Yw2) in the CIE 1931 color space are substantially equal, it means that the third chromaticity value (Xw3, Yw3) and the second chromaticity value (Xw2, Yw2) match each other. The technology about the CIE 1931 color space is well known to those skilled in the art, and is not redundantly described herein. In this embodiment, the following settings are defined in the control module 23. If both of the X coordinate difference and the Y coordinate difference between the third chromaticity value (Xw3, Yw3) and the second chromaticity value (Xw2, Yw2) are lower than 0.01, the control module 23 judges that the third chromaticity value (Xw3, Yw3) matches the second chromaticity value (Xw2, Yw2). Whereas, if the X coordinate difference or the Y coordinate difference between the third chromaticity value (Xw3, Yw3) and the second chromaticity value (Xw2, Yw2) is not lower than 0.01, the control module 23 judges that the third chromaticity value (Xw3, Yw3) does not match the second chromaticity value (Xw2, Yw2). In this embodiment, the base value for determining the X coordinate difference and the Y coordinate difference is 0.01. It is noted that the base value for determining the X coordinate difference and the Y coordinate difference is not restricted.

If the judging result of the sub-step C4 indicates that the third chromaticity value (Xw3, Yw3) matches the second chromaticity value (Xw2, Yw2), the control module 23 performs the sub-step C5. Whereas, if the judging result of the sub-step C4 indicates that the third chromaticity value (Xw3, Yw3) does not match the second chromaticity value (Xw2, Yw2), the control module 23 performs the sub-step C1 repeatedly. That is, the current values corresponding to the red light-emitting unit 221, the green light-emitting unit 222 and the blue light-emitting unit 223 are adjusted until the third chromaticity value (Xw3, Yw3) corresponding to the produced third white light beam matches the second chromaticity value (Xw2, Yw2). If the judging result of the sub-step C4 indicates that the third chromaticity value (Xw3, Yw3) corresponding to the produced third white light beam matches the second chromaticity value (Xw2, Yw2), the sub-step C5 is performed. That is, the current value corresponding to the red light-emitting unit 221, the current value corresponding to the green light-emitting unit 222 and the current value corresponding to the blue light-emitting unit 223 are retrieved as the first adjusting parameter by the control module 23.

After the step C is completed, the control module 23 performs the sub-step D1. The current value corresponding to the white light-emitting unit 224 is adjusted according to the third luminance value L3, and thus the fourth white light beam is produced by the white light-emitting unit 224. Moreover, the light measurement device 202 is enabled to measure the fourth white light beam, and thus a fourth luminance value L4 and a fourth chromaticity value (Xw4, Yw4) corresponding to the fourth white light beam are acquired. Then, the control module 23 performs the sub-step D2 to judge whether the fourth luminance value L4 corresponding to the fourth white light beam matches the third luminance value L3. In this embodiment, the following settings are defined in the control module 23. If the error between the fourth luminance value L4 and the third luminance value L3 is smaller than 5%, it means that the fourth luminance value L4 matches the third luminance value L3. In this embodiment, the base error value is 5%. It is noted that the base error value is not restricted.

If the judging result of the sub-step D2 indicates that the fourth luminance value L4 matches the third luminance value L3, the control module 23 performs the sub-step D3. Whereas, if the judging result of the sub-step D2 indicates that the fourth luminance value L4 does not match the third luminance value L3, the control module 23 performs the sub-step D1 repeatedly. That is, the current value corresponding to the white light-emitting unit 224 is adjusted until the fourth luminance value L4 corresponding to the fourth white light beam matches the third luminance value L3.

As mentioned above, if the judging result of the sub-step D2 indicates that the fourth luminance value L4 matches the third luminance value L3, the control module 23 performs the sub-step D3. In the sub-step D3, the current value corresponding to the white light-emitting unit 224 is retrieved as the second adjusting parameter by the control module 23.

After the step C and the step D are completed, the control module 23 acquires the first adjusting parameter and the second adjusting parameter. Moreover, according to the first adjusting parameter and the second adjusting parameter, the current ratios between the current value corresponding to the red light-emitting unit 221, the current value corresponding to the green light-emitting unit 222, the current value corresponding to the blue light-emitting unit 223 and the current value corresponding to the white light-emitting unit 223 can be obtained.

Afterwards, in the step E, the control module 23 controls the color light-emitting element 22 to produce the mixed light beam according to the current ratios and performs the gray level adjustment process. Meanwhile, the color adjusting method is completed. The gray level adjustment process is well known to those skilled in the art, and is not redundantly described herein.

From the above descriptions, the present invention provides a color adjusting method for a color light-emitting element. Before the gray level adjustment process, the first white light beam produced by the red light-emitting unit, the green light-emitting unit and the blue light-emitting unit and the second white light beam produced by the white light-emitting unit are compared with each other, and the first adjusting parameter is acquired according to the second chromaticity value corresponding to the second white light beam. Moreover, the red light beam, the green light beam and the blue light beam from the red light-emitting unit, the green light-emitting unit and the blue light-emitting unit are mixed as the third white light beam. Then, the second adjusting parameter is acquired according to the third luminance value corresponding to the third white light beam. According to the first adjusting parameter and the second adjusting parameter, the mixed light beam produced by the color light-emitting element is adjusted. In comparison with the conventional technology, the color adjusting method of the present invention is beneficial. After the mixed light beam is subjected to the gray level adjustment process, the errors of the luminance and the chromaticity of the mixed light beam are largely reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A color adjusting method for a color light-emitting element of an input device, the color light-emitting element comprising a red light-emitting unit, a green light-emitting unit, a blue light-emitting unit and a white light-emitting unit, the color adjusting method comprising steps of:

(A) enabling the color light-emitting element, wherein after the color light-emitting element is enabled, a first white light beam is produced by the red light-emitting unit, the green light-emitting unit and the blue light-emitting unit collaboratively, and a second white light beam is produced by the white light-emitting unit;

(B) measuring the second white light beam to acquire a second chromaticity value corresponding to the second white light beam;

(C) controlling the red light-emitting unit, the green light-emitting unit and the blue light-emitting unit to produce a third white light beam according to the second chromaticity value, and acquiring a first adjusting parameter corresponding to the red light-emitting unit, the green light-emitting unit and the blue light-emitting unit, wherein a third chromaticity value corresponding to the third white light beam matches the second chromaticity;

(D) controlling the white light-emitting unit to produce a fourth white light beam according to a third luminance value corresponding to the third white light beam, and acquiring a second adjusting parameter corresponding to the white light-emitting unit, wherein a fourth luminance value corresponding to the fourth white light beam matches the third luminance value; and (E) performing a gray level adjustment process according to the first adjusting parameter and the second adjusting parameter.

2. The color adjusting method according to claim 1, wherein the step (A) comprises sub-steps of:

(A1) driving the red light-emitting unit to emit a first red light beam;

(A2) driving the green light-emitting unit to emit a first green light beam;

(A3) driving the blue light-emitting unit to emit a first blue light beam, wherein the first red light beam, the first green light beam and the first blue light beam are mixed as the first white light beam; and (A4) driving the white light-emitting unit to emit a second white light beam.

3. The color adjusting method according to claim 1, wherein the step (B) comprises sub-steps of:

(B1) measuring the first white light beam to acquire a first luminance value and a first chromaticity value corresponding to the first white light beam; and (B2) measuring the second white light beam to acquire a second luminance value and the second chromaticity value corresponding to the second white light beam.

4. The color adjusting method according to claim 3, wherein the first luminance value and the second luminance value are measured by a luminance meter, and the first chromaticity value and the second chromaticity value are measured by a chromatometer.

5. The color adjusting method according to claim 1, wherein the step (C) comprises sub-steps of:

(C1) adjusting a current value corresponding to the red light-emitting unit according to the second chromaticity value, so that the red light-emitting unit emits a second red light beam;

(C2) adjusting a current value corresponding to the green light-emitting unit according to the second chromaticity value, so that the green light-emitting unit emits a second green light beam;

(C3) adjusting a current value corresponding to the blue light-emitting unit according to the second chromaticity value, so that the blue light-emitting unit emits a second blue light beam, wherein the second red light beam, the second green light beam and the second blue light beam are mixed as the third white light beam;

(C4) judging whether the third chromaticity value corresponding to the third white light beam matches the second chromaticity value; and (C5) retrieving the current value corresponding to the red light-emitting unit, the current value corresponding to the green light-emitting unit and the current value corresponding to the blue light-emitting unit as the first adjusting parameter.

6. The color adjusting method according to claim 5, wherein if a judging result of the sub-step C4 indicates that the third chromaticity value corresponding to the third white light beam matches the second chromaticity value, the sub-step C5 is performed, wherein if the judging result of the sub-step C4 indicates that the third chromaticity value corresponding to the third white light beam does not match the second chromaticity value, the step C1 is repeatedly done.

7. The color adjusting method according to claim 1, wherein the step (D) comprises sub-steps of:

(D1) adjusting a current value corresponding to the white light-emitting unit according to the third luminance value, so that the fourth white light beam is produced by the white light-emitting unit;

(D2) judging whether the fourth luminance value corresponding to the fourth white light beam matches the third luminance value; and (D3) retrieving the current value corresponding to the white light-emitting unit as the second adjusting parameter.

8. The color adjusting method according to claim 7, wherein if a judging result of the sub-step D2 indicates that the fourth luminance value corresponding to the fourth white light beam matches third luminance value, the sub-step D3 is performed, wherein if the judging result of the sub-step D2 indicates that the fourth luminance value corresponding to the fourth white light beam does not match third luminance value, the step D1 is repeatedly done.

9. An input device with a color adjusting function, the input device comprising:

a casing;

a color light-emitting element disposed within the casing, and comprising a red light-emitting unit, a green light-emitting unit, a blue light-emitting unit and a white light-emitting unit, wherein the red light-emitting unit is disposed within the casing and emits a red light beam to the casing, the green light-emitting unit is disposed within the casing and emits a green light beam to the casing, the blue light-emitting unit is disposed within the casing and emits a blue light beam to the casing, and the white light-emitting unit is disposed within the casing and emits a white light beam to the casing; and a control module disposed within the casing, and connected with the red light-emitting unit, the green light-emitting unit, the blue light-emitting unit and the white light-emitting unit, wherein the control module adjusts an adjusting parameter corresponding to the red light-emitting unit, the green light-emitting unit, the blue light-emitting unit and the white light-emitting unit, wherein according to the adjusting parameter, a chromaticity value of a mixed light beam of the red light beam, the green light beam and the blue light beam is adjusted to match a chromaticity value of the white light beam from the white light-emitting unit, and a luminance value of an additional white light beam from the white light-emitting unit is adjusted to match a luminance value of the mixed light beam.

10. The input device according to claim 9, wherein if the chromaticity value of the mixed light beam is adjusted to match the chromaticity value of the light beam, the control module retrieves a current value corresponding to the red light-emitting unit, a current value corresponding to the green light-emitting unit and a current value corresponding to the blue light-emitting unit, wherein if the chromaticity value of the mixed light beam does not match the chromaticity value of the light beam, the control module adjusts the chromaticity value of the mixed light beam again.

11. The input device according to claim 10, wherein if the luminance value of the additional white light beam is adjusted to match the luminance value of the mixed light beam, the control module retrieves the current value corresponding to the white light-emitting unit, wherein if the luminance value of the additional white light beam does not match the luminance value of the mixed light beam, the control module adjusts the luminance value of the additional white light beam again.

12. The input device according to claim 9, wherein the adjusting parameter includes current ratios between a current value corresponding to the red light-emitting unit, a current value corresponding to the green light-emitting unit, a current value corresponding to the blue light-emitting unit and a current value corresponding to the white light-emitting unit.

* * * * *